US009877546B2

(12) United States Patent
Rehkemper

(10) Patent No.: US 9,877,546 B2
(45) Date of Patent: Jan. 30, 2018

(54) DEVICE FOR CREATING SMOKE THAT EMANATES FROM AN EXTERNAL FOOT COVERING

(71) Applicant: Matthew Rehkemper, Wichita Falls, TX (US)

(72) Inventor: Matthew Rehkemper, Wichita Falls, TX (US)

( * ) Notice: Subject to any disclaimer, the term of this patent is extended or adjusted under 35 U.S.C. 154(b) by 248 days.

(21) Appl. No.: 14/091,716

(22) Filed: Nov. 27, 2013

(65) Prior Publication Data

US 2014/0352177 A1 Dec. 4, 2014

Related U.S. Application Data

(60) Provisional application No. 61/827,954, filed on May 28, 2013.

(51) Int. Cl.
*A43B 23/24* (2006.01)
*A43B 3/00* (2006.01)
*A43B 3/30* (2006.01)

(52) U.S. Cl.
CPC ..... *A43B 23/24* (2013.01); *A43B 3/001* (2013.01); *A43B 3/0015* (2013.01); *A43B 3/30* (2013.01)

(58) Field of Classification Search
CPC ..... A43B 23/24; A43B 3/001; A43B 3/0015; A43B 3/30
USPC ..... 36/114
See application file for complete search history.

(56) References Cited

U.S. PATENT DOCUMENTS

| | | | | |
|---|---|---|---|---|
| 1,649,236 | A * | 11/1927 | Jurcsak | 36/3 R |
| 5,471,768 | A * | 12/1995 | Pryor | 36/3 R |
| 5,491,972 | A * | 2/1996 | Bretz et al. | 60/39.821 |
| 5,564,201 | A * | 10/1996 | O'Connell | A43B 13/00 36/112 |
| 5,617,650 | A * | 4/1997 | Grim | 36/88 |
| 5,924,221 | A * | 7/1999 | Schuver et al. | 36/136 |
| 6,094,844 | A * | 8/2000 | Potts | 36/136 |
| 6,398,126 | B1 * | 6/2002 | Pitchford | 239/36 |
| 6,601,776 | B1 * | 8/2003 | Oljaca et al. | 239/5 |
| 6,865,825 | B2 * | 3/2005 | Bailey et al. | 36/88 |
| 7,107,706 | B1 * | 9/2006 | Bailey et al. | 36/88 |
| 7,523,565 | B1 * | 4/2009 | Chen | 36/29 |
| 8,495,767 | B2 * | 7/2013 | Berglund et al. | 2/457 |
| 8,667,708 | B2 * | 3/2014 | Tsiantos | 36/3 B |
| 2005/0005473 | A1 * | 1/2005 | Oh | 36/29 |

(Continued)

*Primary Examiner* — Shaun R Hurley
*Assistant Examiner* — Bao-Thieu L Nguyen
(74) *Attorney, Agent, or Firm* — Gagnon, Peacock & Vereeke P.C.; Aaron P. Peacock

(57) ABSTRACT

A device worn on a foot of an individual for creating smoke that emanates about the device as the individual walks or runs, the device having a tube with two end portions wherein one end portion is closed and the other end portion is open, an exhaust pipe having two end portions, one end portion is open and the other end portion is substantially closed and permits smoke to escape therefrom, the open end portion of the exhaust pipe connects to the open end portion of the tube, the exhaust pipe having an air chamber positioned at the open end portion of the exhaust pipe, an atomizer, a liquid cartridge and a battery, and an external foot covering that houses the tube and the exhaust pipe wherein the end portion of the exhaust pipe, which permits smoke to escape therefrom, protrudes outward from the exterior side of the shoe.

7 Claims, 8 Drawing Sheets

(56) References Cited

U.S. PATENT DOCUMENTS

| | | | | |
|---|---|---|---|---|
| 2006/0021261 | A1* | 2/2006 | Face | 36/132 |
| 2006/0042127 | A1* | 3/2006 | Shattuck | 36/136 |
| 2007/0051245 | A1* | 3/2007 | Yun | 96/281 |
| 2007/0079889 | A1* | 4/2007 | Lindsay et al. | 141/83 |
| 2008/0163517 | A1* | 7/2008 | Chen | A43B 7/081 36/3 B |
| 2008/0229623 | A1* | 9/2008 | Ferretti | 36/3 B |
| 2010/0180473 | A1* | 7/2010 | Rosenberger | A43B 1/0027 36/136 |
| 2011/0011396 | A1* | 1/2011 | Fang | 128/202.21 |
| 2011/0056092 | A1* | 3/2011 | Tsiantos | A43B 1/0045 36/103 |
| 2014/0250730 | A1* | 9/2014 | Rosenberger | 36/103 |
| 2014/0270730 | A1* | 9/2014 | DePiano et al. | 392/404 |

* cited by examiner

SECTION A-A

SECTION B-B

DEVICE FOR CREATING SMOKE THAT EMANATES FROM AN EXTERNAL FOOT COVERING

CROSS-REFERENCE TO RELATED APPLICATIONS

Applicant claims priority to U.S. Provisional Patent Application No. 61/827,954, filed May 28, 2013, the disclosure of which is incorporated by reference herein in its entirety.

BACKGROUND OF THE INVENTION

Figure 1:
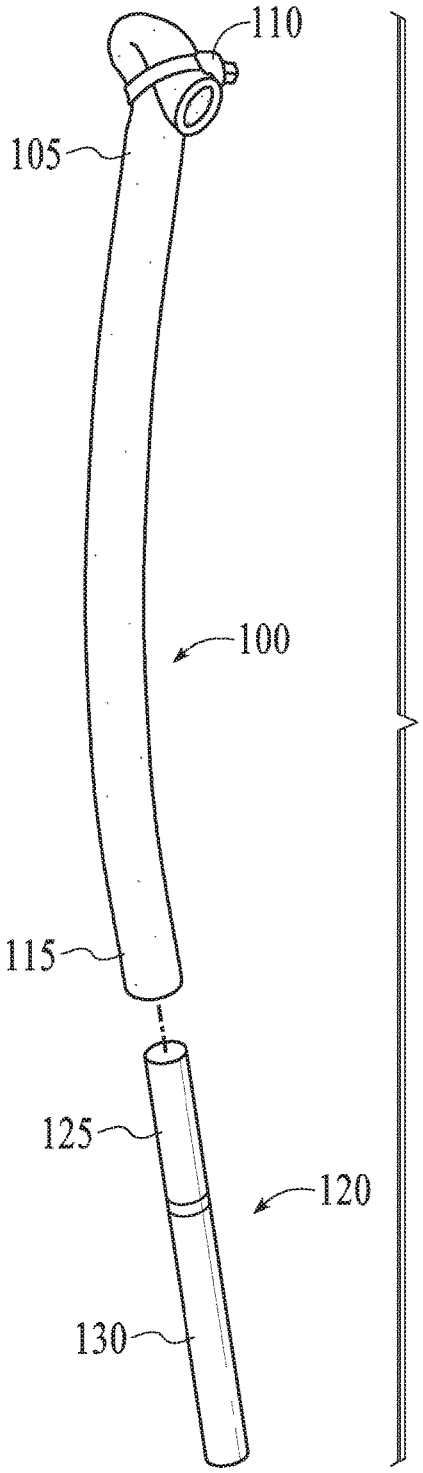
FIG. 1 is a perspective view of a latex tube and an exhaust pipe.

Each individual is created with the capacity to perceive, understand, appreciate and enjoy various forms of entertainment. Different types and forms of entertainment are found in nearly all aspects of life. From the first breath of an infant until the last breath of an elder, each person encounters situations consisting of differing forms of entertainment throughout the span of life. Some forms and types of entertainment help pass the time and provide a pleasurable experience to those partaking, while other forms and types of entertainment, when coupled with other beneficial ventures and/or activities, assist in producing a desired result. As such, entertainment is ubiquitous and is found in almost every endeavor and activity of life. Whether at work or at play, people of all ages love to entertain and be entertained.

Especially commonplace among children, teenagers and young adults are the engagement of activities and/or the use of devices which provided entertainment such as playing video games, participating in extra-curricular activities and watching television, movies and cartoons. These younger individuals depend heavily upon activities that engage the imagination of the mind. As such, one form and/or type of entertainment that engages children and young adults is the ability to imagine (i.e., to pretend). Children are drawn to the world of make believe. Hence, the world of pretend has given rise to superheroes that can undertake activities that mere mortals cannot do in their own strength. For example, many young individuals imagine themselves as having the ability to possess extraordinary powers such as having the ability to be faster than a speeding bullet, more powerful than a locomotive and leap tall buildings in a single bound.

The capacity to pretend is limitless for young individuals, however many times external objects are needed to help jumpstart the young individuals' creative juices. Often times, devices, gadgets, articles, games and programs are used to aid young individuals' ability to imagine. With the aid of such objects, young peoples' minds can become engaged in the world of pretend and they and their friends can have fun together as they entertain themselves.

A particular extraordinary ability that many young individuals' imagine having is the ability to run extremely fast. For centuries, societies have rewarded fast runners. For example, Olympic Games are played to determine the world's fastest runner. Running is not only a sport; it can be a person's claim to fame. However, having the label of world's fastest man/woman is a not a reality for most people; it is something that most only dream about. In their world of pretend, children and young adult tend to imagine that they are extraordinary, having superhuman abilities that enable them to run fast—faster than normal. They may picture themselves as the fastest man or woman on earth, running so fast indeed that the rubber on their shoes begins to smoke.

Smoke that billows from a shoe because of extreme heat and friction cause by extreme, rapid movement brings to life the imagination of young children and adults that they are superhuman. Having this superhuman ability is an entertainment form that a person—particularly a young person—can enjoy individually or together with family and/or friends. For example, a young person could engage his or her friends to jokingly convince them that the shoes are smoking because of the young person's superhuman running abilities. Also, a group of individuals, each wearing shoes that smoke, could couple the smoking shoes with their imaginations for entertainment purposes, allowing the individuals to pretend and use their imagination. Thus, shoes from which smoke emanates can be utilized for many different purposes—especially for entertainment purposes.

What is needed is a device that aids in providing entertainment for children and adults alike which allows the world of imagination of superhuman strengths to come alive. More specifically, what is needed is a device that can be worn on an individual's foot such as, but not limited to, a shoe from which smoke/heat/vapor emanates thereby providing an allusion that the wearer of the device possesses supernatural mobility and strength which enables the wearer to run at superhuman speeds.

A device for providing continuous and/or intermittent smoke/vapor which emanate from an external covering of the human foot, having at least one embodiment disclosed herein, is a novel invention that meets the needs described in the aforementioned paragraphs, while also providing many substantial advantages such as, but not limited to, the ability to easily and effectively interface with an ordinary shoe and the ability to cause the smoke to intermittently and/or continuously emanate from the device based upon actions/inactions of the user of the device.

An embodiment of the present invention can interface with an ordinary shoe. Thus, an embodiment can include a running shoe, such as, but not limited to, a tennis shoe, which enhances a user's ability to utilize the present invention for entertainment purposes. While any type of footwear may be suitable, a running shoe has more significance in the world of a young person's imagination and may provide a better entertainment experience. Therefore, a running shoe may be more desirable. However, it should be understood that while embodiments of the present invention can include, be integrated with and utilize an external foot covering such as, but not limited to, a shoe having any form or type, subsequently hereafter this paper will describe a running shoe (i.e., a tennis shoe) for purposes of explanation and example.

Moreover, an embodiment of the present invention permits a user of the invention to regulate the amount of smoke/vapor that emanates from a shoe via the actions of the user. The more steps a user takes when employing the device, the greater amount of smoke/vapor that emanates from the device. On the other hand, a reduction of successive steps taken by the user of the device will results in a corresponding reduction of the emanation of smoke/vapor. As such, the present invention includes a mechanism for regulating the amount of emanating smoke/vapor. The mechanism activates as a user takes a step. As steps become more rapid, the emanating smoke increases. However, when the user stands still, the device ceases emanating smoke/vapor. Thus, the present invention can include the novel function of permitting continuous emanating of smoke/vapor as a user continuously runs or walks or intermittent emanation of smoke as when a user walks/runs, stops, then continues running/walking, and so on.

Elements of an embodiment of the present invention includes, without limitation, a tube having one end thereof connected to one end of an exhaust pipe, wherein both the tube and exhaust pipe are positioned within a shoe or other similar external foot covering. The exhaust pipe includes, without limitation, an atomizer which creates smoke/vapor. The other end of the exhaust pipe protrudes through a portion of the shoe, thereby allowing smoke to pass through the exhaust pipe and emanate from the exterior of the shoe. Emanating smoke from the exterior of the shoe provides the allusion that the shoe is smoking due to the extreme and rapid movements of the user.

Specifically as a user of the invention/device walks or runs, the user's downward weight onto the shoe squeezes the tube that is within the shoe which forces air out of the tube and through the shoe exhaust pipe. Then, the user's weight shifts to the other foot, which removes the downward pressure on the tube, thereby causing smoke/vapor that is created by an atomizer within the exhaust pipe to rush into the tube from the shoe exhaust pipe. The user then shifts his or her weight again and applies downward pressure back onto the shoe and thus onto the tube, causing the smoke that is within the tube to pass through the exhaust pipe and out of the end portion of the exhaust pipe that protrudes from the shoe. As the smoke exits the exhaust pipe, it appears to emanate from the side or bottom of the shoe.

Again, the user's weight shifts, again causing a low pressure in the tube so that smoke/vapor produced from the atomizer in the exhaust pipe rushes into the tube. Then, the weight shifts again, pushing the smoke/vapor out of the tube, through the exhaust pipe and out of the end portion of the exhaust pipe protruding out of the shoe. This process repeats itself over and over as the user of the invention/device walks or runs.

DETAILED DESCRIPTION

While the present invention encompasses numerous embodiments involving differing articles of manufacture, devices, elements and/or methods, one particular embodiment disclosed herein includes the creation and emanation of smoke/vapor from an external foot covering using a standard shoe which is slightly modified for the present invention, a latex tube, an exhaust pipe which includes an atomizer, a cartridge containing liquid and a battery. An electronic vaping device, also known as a personal vaporizer or electronic cigarette, can function as an exhaust pipe in the present invention. An electronic vaping device includes an atomizer which comprises a battery, a liquid cartridge and small heating elements responsible for vaporizing liquids located in the liquid cartridge. When low pressure is created in the electronic vaping device, the atomizer is activated, thereby heating the liquid in the liquid cartridge and converting the liquid to a vapor which often appears as smoke. Furthermore, often many electronic vaping devices have an light-emitting diode (LED) at one end that lights up when the electronic vaping device experiences low pressure at an end.

Turning now to FIG. 1, an illustration is shown that depicts a latex tube 100 and an exhaust pipe 120. The latex tube 100 has two ends wherein one end 105 is closed and the other end 115 is open. A tie 110 is utilized to fasten the folded end 105 to the latex tube 100, creating a kink at the folded end 105, thereby sealing that portion of the latex tube 100. Also depicted is the exhaust pipe 120, which, for this embodiment, is an electronic vaping device having an open end portion 125 comprising an air chamber which includes an atomizer and liquid cartridge therein and a substantially closed end portion 130 which permits air and smoke/vapor to escape and may also include a light-emitting diode (LED) and battery positioned thereon. A person of ordinary skill in the art will appreciate that the exhaust pipe 120 can be an electronic vaping device as depicted in FIG. 1 or can be any type or form of exhaust pipe 120 which comprises, without limitation, an atomizer, liquid cartridge and battery to power the atomizer. Moreover, it should be noted that the latex tube 100 can be a tube comprised of latex as depicted in FIG. 1 or of any other type of similar construct.

Figure 2:
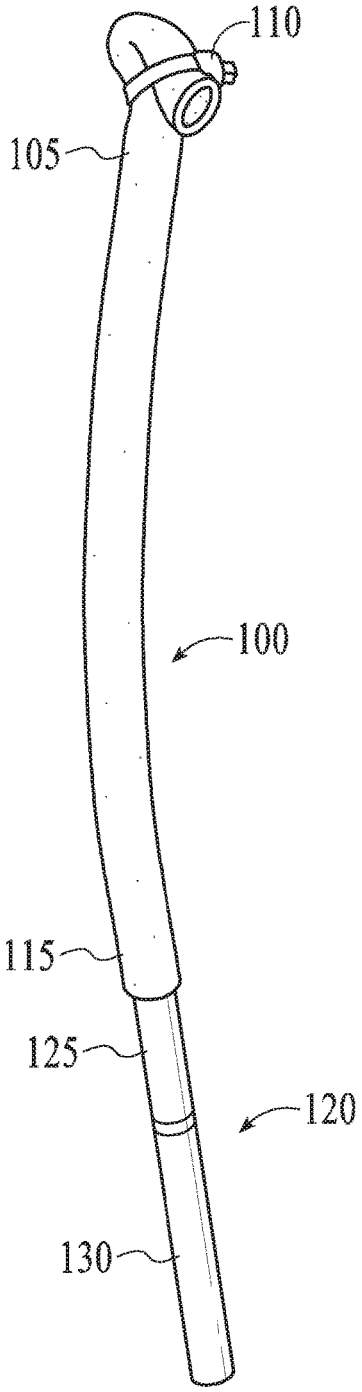
FIG. 2 is a perspective view of the latex tube and the exhaust pipe of FIG. 1 fitted together.

FIG. 2 depicts the latex tube 100 connected to the exhaust pipe 120. The open end 115 of the latex tube 100 is fitted onto the air chamber end portion 125 of the exhaust pipe 120. When pressure is applied to the exterior of the latex tube 100, thereby increasing air pressure inside the latex tube 100, the air inside the latex tube 100 rushes into the exhaust pipe 120, passing through air chamber end portion 125 of the exhaust pipe 120 and out through the end portion 130 thereof. Once the pressure is removed from the exterior of the latex tube 100, a low pressure area is created both inside the latex tube 100 and in the end portion 125 of the exhaust pipe 120 comprising the air chamber. The low pressure area inside the end portion 125 having the air chamber causes the atomizer of the exhaust pipe 120 to create vapor/smoke and that vapor/smoke rushes from the air chamber into the inside of the latex tube 100. Then, when pressure is once again applied to the exterior of the latex tube 100, the vapor/smoke within the latex tube 100 is pushed into the exhaust pipe 120, through the air chamber and out of the end portion 130. When the pressure is removed from the exterior of latex tube 100, vapor/smoke fills the inside of the latex tube 100 once again due to the low pressure area created in the air chamber of the exhaust pipe 120 and latex tube 100. Then, when pressure is reapplied to the exterior of the latex tube 100, the vapor/smoke is pushed once again through the exhaust pipe 120 and out of the end portion 130.

Figure 3:
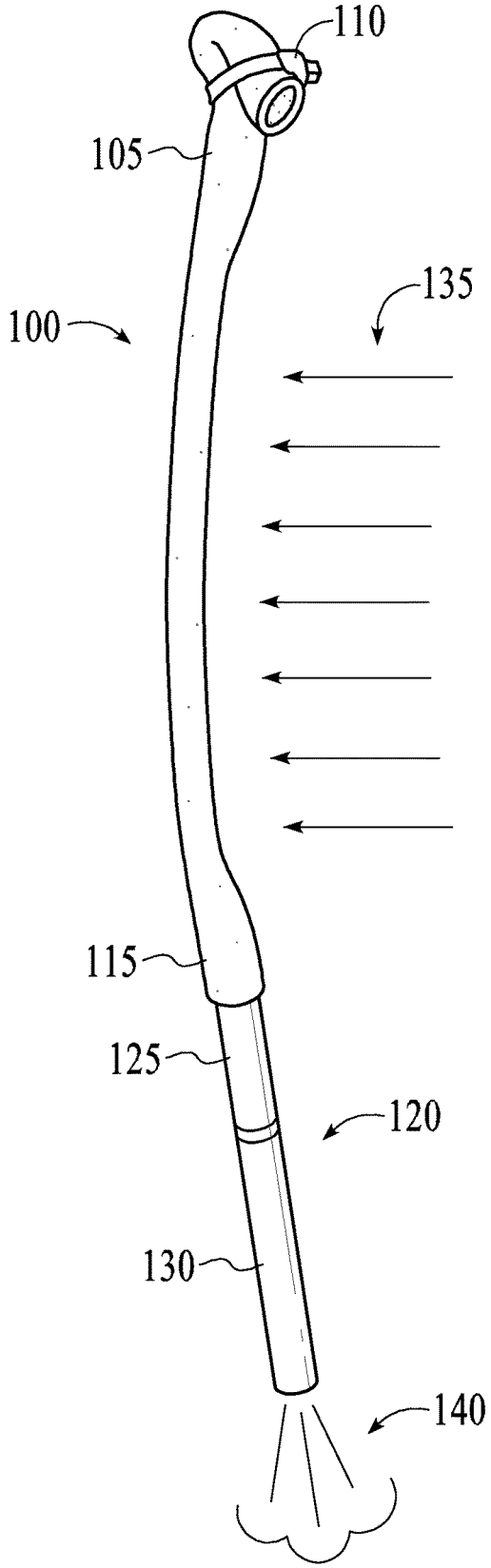
FIG. 3 is a side view of FIG. 2 wherein pressure is being applied to the exterior of the latex tube, resulting in smoke emanating from the exhaust pipe.

FIG. 3 depicts vapor/smoke 140 emanating from the end portion 130 of the exhaust pipe 120 as pressure 135 is applied to the exterior of the latex tube 100, thereby causing the vapor/smoke 140 within the latex tube 100 to be pushed through the interior of the exhaust pipe 120 and out through the end portion 130. This process repeats itself over and over again, thereby allowing vapor/smoke to continuously emanate from the end portion 130 of the exhaust pipe 120. If, however, pressure is only applied intermittently to the exterior of the latex tube 100, then vapor/smoke will also intermittently emanate from the end portion 130 of the exhaust pipe 120.

Figure 4:
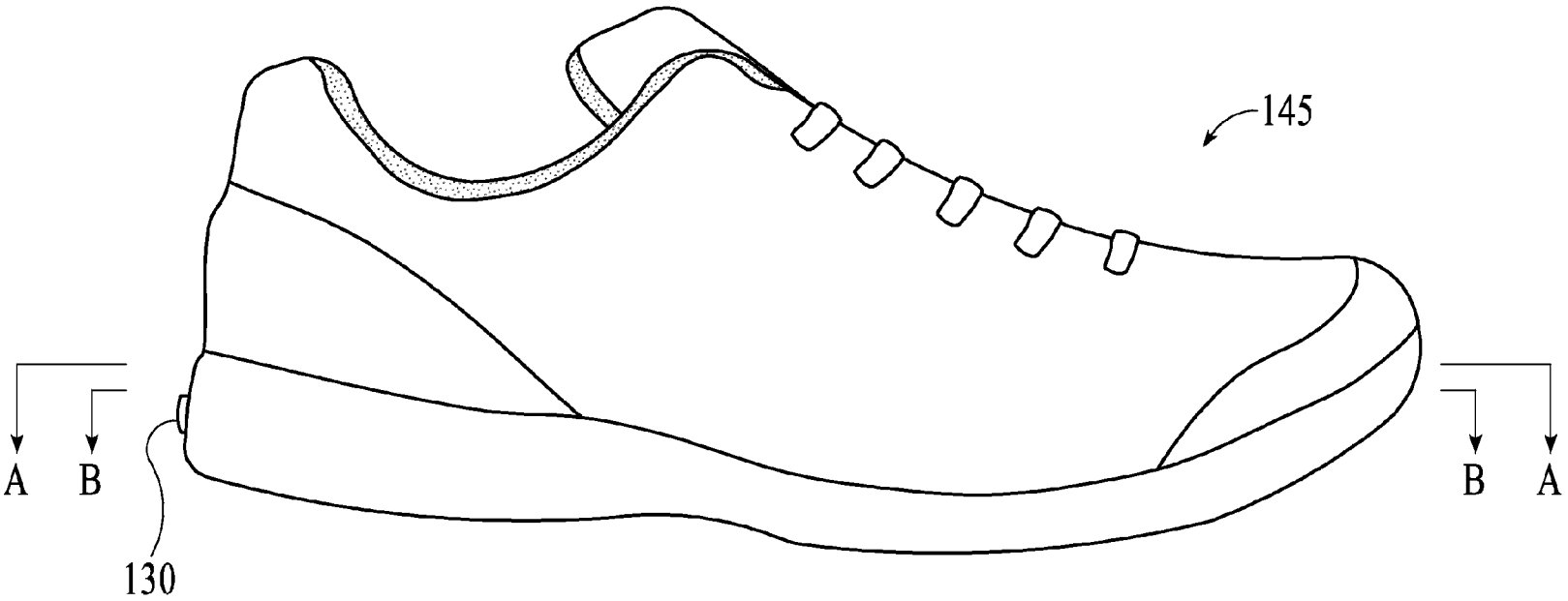
FIG. 4 is a side view of a shoe depicting an end portion of the exhaust pipe protruding therefrom.

FIG. 4 depicts a standard, ordinary shoe 145 such as, without limitation, a tennis shoe. The shoe 145 has been slightly modified to allow the end portion 130 of the exhaust pipe 120 to protrude slightly outward from the back of the shoe 145. Vapor/smoke 140 emanates from the end portion 130 of the exhaust pipe 120 positioned at the back of the shoe 145. The end portion 130 is position in such a way so that the smoke 140 emanating from the end portion 130 creates an allusion that the smoke 140 is really emanating from the side and/or bottom of the shoe 145 due to heat and/or friction caused by fast running. Furthermore, FIG. 4 depicts cross section A and cross section B.

Figure 5:
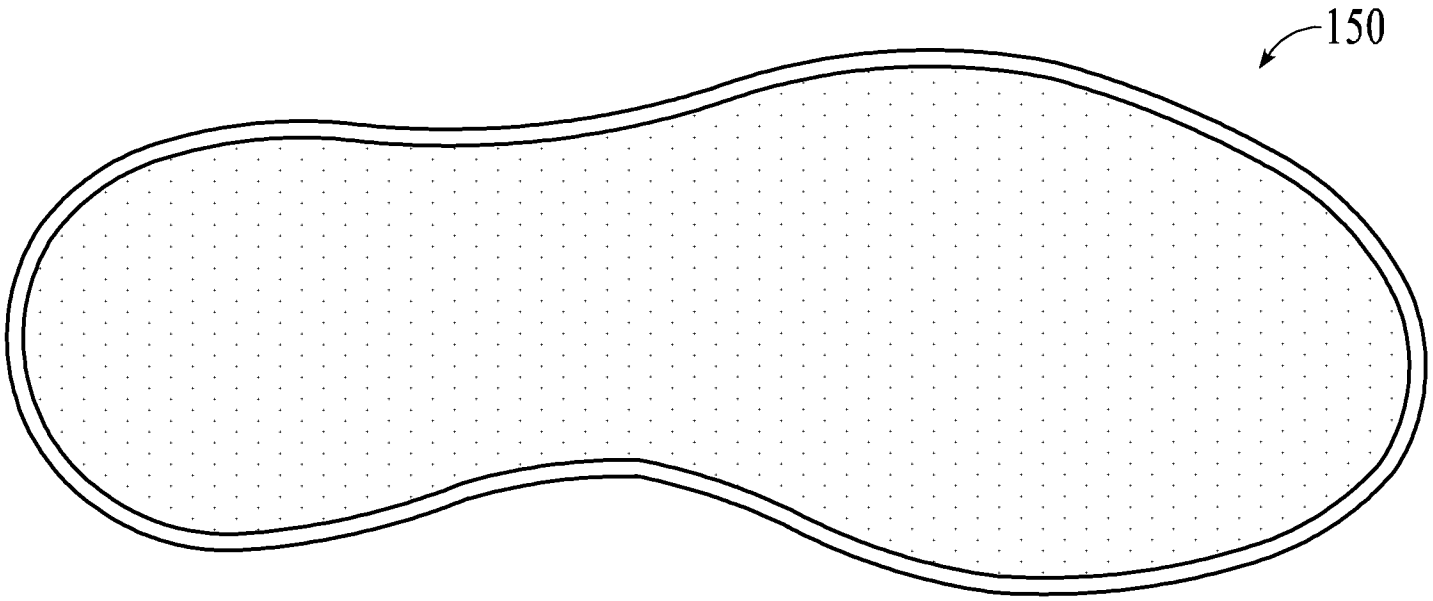
FIG. 5 is a cross-section view of Section A-A in FIG. 4, depicting the shoe as well as the insole.

FIG. 5 depicts section A-A of cross section A of FIG. 4. FIG. 5 shows a section 150 which includes the insole as well as part of the shoe 145. A person would position his or her foot inside the shoe 145 and on top of the insole as one would normally wear a shoe.

Figure 6:
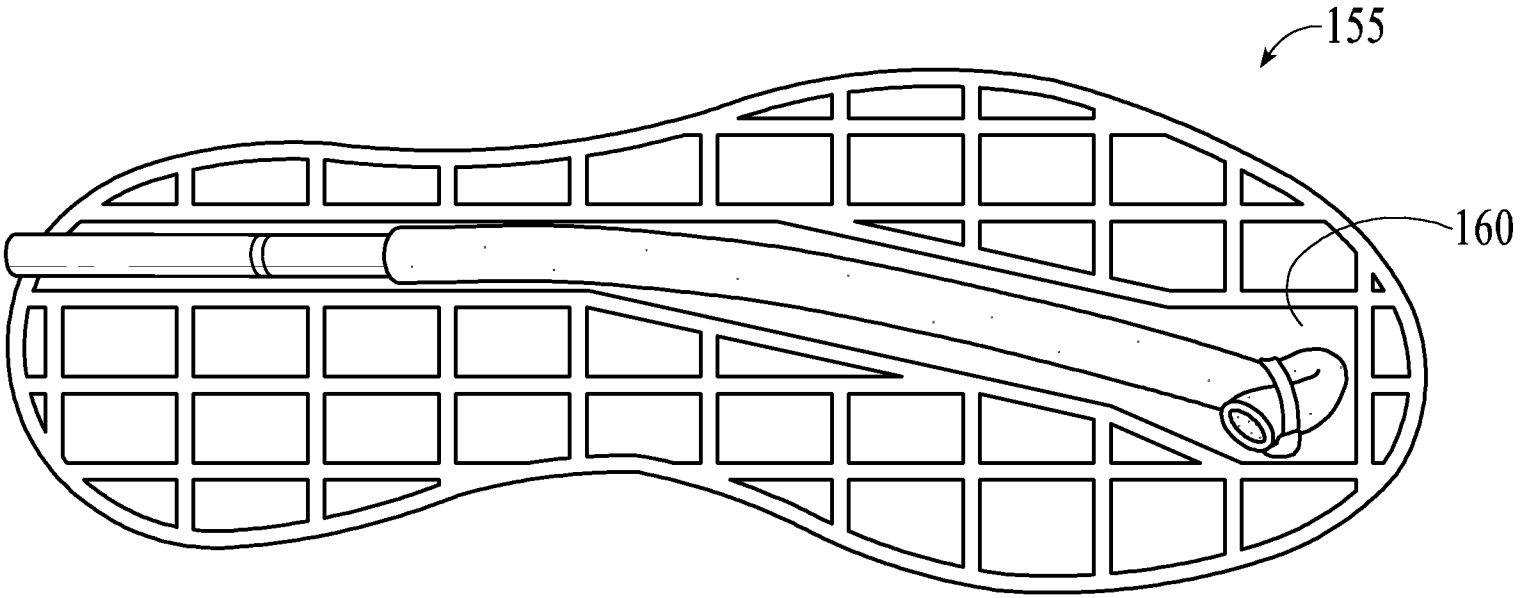
FIG. 6 is a cross-sectional view of Section B-B in FIG. 4, depicting the latex tube connected to the exhaust pipe, each housed within the shoe.

FIG. 6 depicts section B-B of cross section B of FIG. 4. FIG. 6 shows section 155 which includes the midsole or outsole as well as part of the shoe 145. The midsole or outsole includes space 160 to house the latex tube 100 and the exhaust pipe 120.

Figure 7:
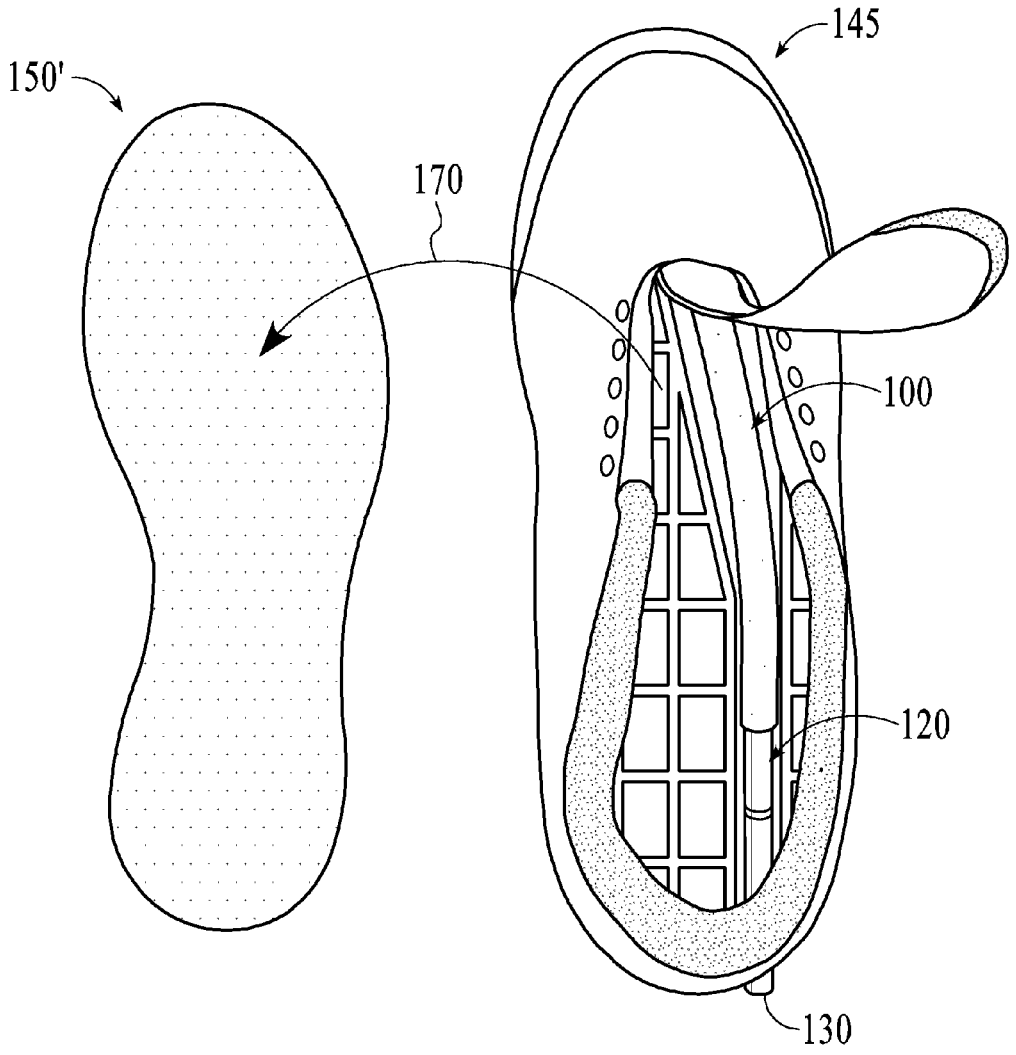
FIG. 7 is a top view of the shoe of FIG. 4 wherein the insole has been removed and the latex tube and exhaust pipe are connected together and are each housed within the shoe and wherein an end portion of the exhaust pipe, which permits smoke to escape from the exhaust pipe, protrudes from the back of the shoe.
Figure 8:
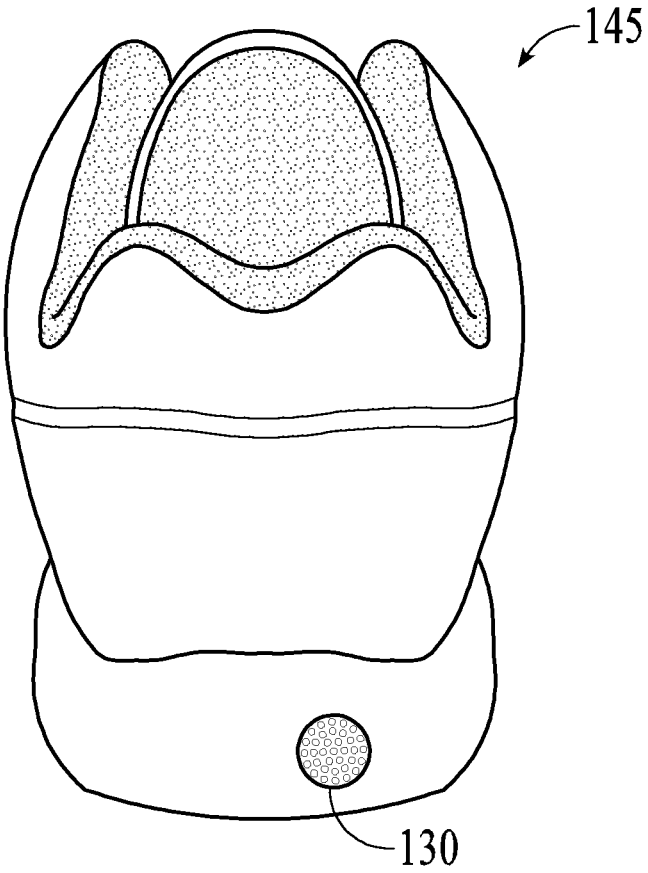
FIG. 8 is a side view of the back of a shoe wherein the end portion of the exhaust pipe, which permits smoke to escape therefrom, protrudes outward from the back of the shoe.

FIG. 7 depicts insole 150' which has been removed 170 from the shoe 145, exposing the latex tube 100 and the exhaust pipe 120 connected together and housed within the midsole or outsole. Also, end portion 130 of the exhaust pipe 120 is shown protruding outward from the back portion of the shoe 145. FIG. 8 depicts a side view of the shoe 145 showing the end portion 130 of the exhaust pipe 120 slightly protruding outward from the shoe 145.

Figure 9:
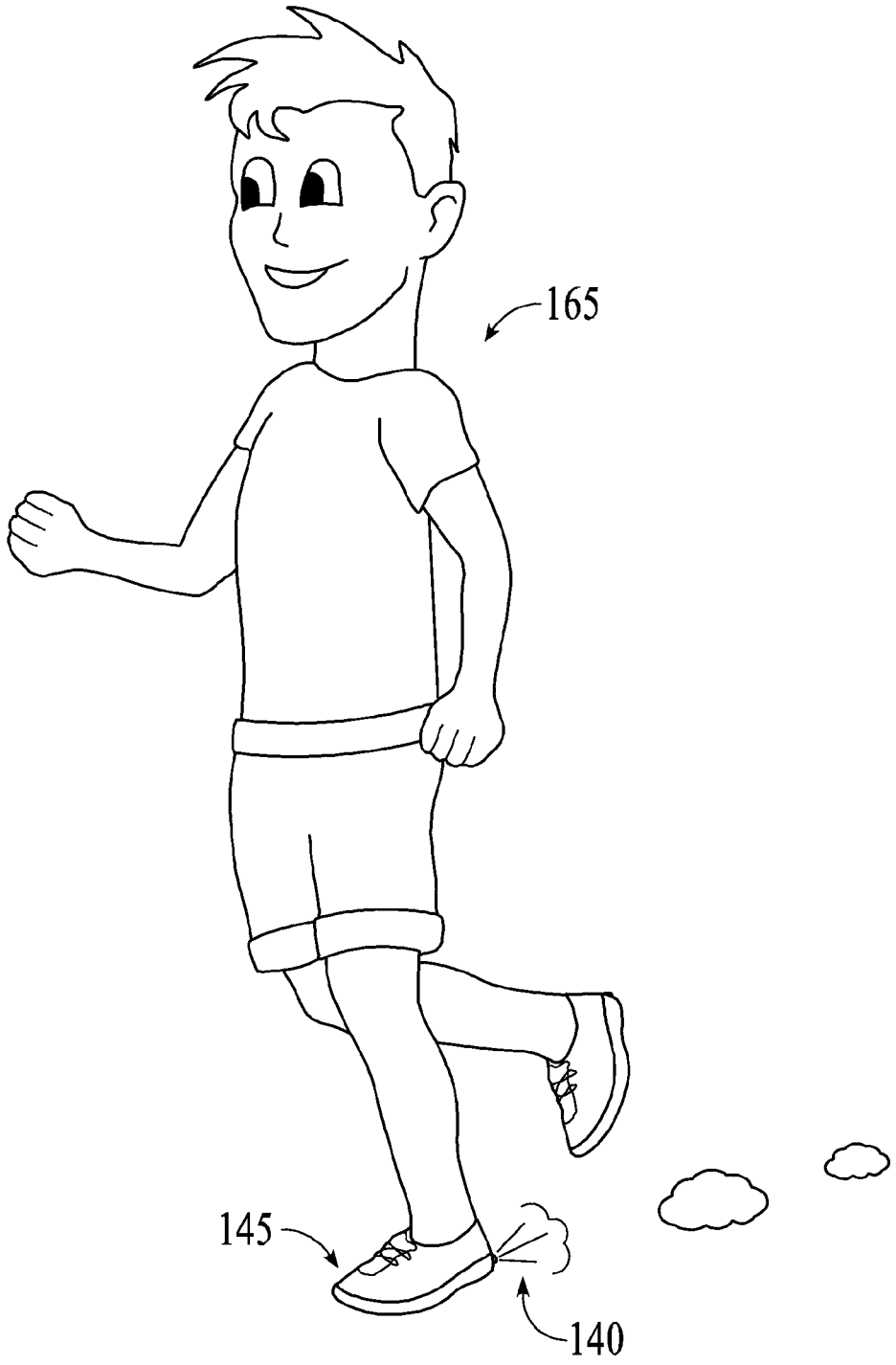
FIG. 9 is a perspective view of an individual wearing a device, comprising an embodiment of the present invention, and running as smoke emanates from the back of the device.

FIG. 9 illustrates a young person 165 running while wearing and using the present invention. As the young person shifts his weight downward onto the shoe 145, smoke/vapor 140 emanates from the back of the shoe 145, thereby creating the allusion that the smoke is being created because of the quickness of the young person, resulting in the burning of the shoe 145.

As disclosed herein, embodiments of the present invention may include a tube, regardless of type, function or properties, tie, regardless of type, function or properties, exhaust pipe, regardless of type, function or properties, atomizer, regardless of type, function or properties, air chamber, regardless of type, function or properties, battery, regardless of type, function or properties, liquid cartridge, regardless of type, function or properties, electronic vaping device, regardless of type, function or properties, electronic cigarette, regardless of type, function or properties, shoe, regardless of type, function or properties, insole, regardless of type, function or properties, midsole, regardless of type, function or properties, outsole, regardless of type, function or properties, external foot covering, regardless of type, function or properties, smoke, regardless of type, function or properties and vapor, regardless of type, function or properties. It should also be noted that vapor and smoke have been used interchangeably.

Although many embodiments of the present invention have been illustrated in the accompanying Drawings and described in the foregoing Detailed Description, it should be understood that the present invention is not limited to the embodiments disclosed, but is capable of numerous rearrangements, modifications, and substitutions of parts and elements without departing from the spirit of the invention.

What is claimed is:

1. A device worn on a foot of an individual for creating smoke that emanates about the device as the individual walks or runs, the device comprising:

a tube having two end portions wherein one end portion of the tube is closed and the other end portion of the tube is open;

an electronic cigarette having two end portions, a first end portion is open and the second end portion permits smoke to escape therefrom, the first end portion of the electronic cigarette connects to the open end portion of the tube; and an external foot covering that houses the tube and the electronic vaping device wherein the substantially closed end portion of the electronic vaping device, which permits smoke to escape therefrom, protrudes outward from the exterior side of the heel of the shoe, thereby permitting smoke to emanate from the shoe and providing an illusion that the shoe is smoking due to friction caused by rapid movement of the shoe.

2. The device of claim 1 wherein the tube is constructed of latex material.

3. The device of claim 2 wherein the external foot covering is a shoe.

4. The device of claim 3 wherein the shoe is a tennis shoe.

5. The device of claim 3 further comprising an insole.

6. A shoe that provides for smoke which emanates therefrom when the shoe is worn by an individual as the individual walks or runs, the shoe comprising;

a tube having two end portions wherein one end portion of the tube is closed and the other end portion of the tube is open; and an electronic cigarette having two end portions, a first end portion is open and the second end portion permits smoke to escape therefrom, the first end portion of the electronic cigarette connects to the open end portion of the tube; and comprises an air chamber that receives and disburses aft and smoke.

7. The device of claim 6 wherein the tube is constructed of latex material.

* * * * *